US005580290A

United States Patent [19]

Zilberstein et al.

[11] Patent Number: 5,580,290

[45] Date of Patent: Dec. 3, 1996

[54] METHOD FOR RECRYSTALLIZATION OF TUNGSTEN FILAMENTS FOR INCANDESCENT LAMPS

[75] Inventors: Galina Zilberstein, Chestnut Hill; James A. Avallon, Beverly; John W. Shaffer, Danvers, all of Mass.

[73] Assignee: Osram Sylvania Inc., Danvers, Mass.

[21] Appl. No.: 490,620

[22] Filed: Jun. 15, 1995

[51] Int. Cl.[6] ..... H01J 9/38; H01J 9/44

[52] U.S. Cl. ..... 445/6; 445/42; 445/56

[58] Field of Search ..... 445/6 OR, 27, 445/38, 40, 42, 56

[56] References Cited

U.S. PATENT DOCUMENTS

| | | | |
|---|---|---|---|
| 1,501,240 | 8/1921 | Rottgardt | 445/56 |
| 3,210,589 | 10/1965 | Mason | 445/6 |
| 3,901,573 | 8/1975 | Dolenga et al. | 445/56 |
| 4,535,268 | 8/1985 | Morris et al. | 445/27 |
| 4,810,932 | 3/1989 | Ahlgren et al. | 313/579 |
| 4,857,804 | 8/1989 | Griffin | 313/557 |
| 5,022,880 | 6/1991 | Shaffer | 445/6 |
| 5,072,147 | 12/1991 | Pugh et al. | 311/341 |

*Primary Examiner*—P. Austin Bradley
*Assistant Examiner*—Jeffrey T. Knapp
*Attorney, Agent, or Firm*—Carlo S. Bessone

[57] ABSTRACT

A method for recrystallization of tungsten filaments for incandescent lamps includes the steps of providing a tungsten filament fixed to lead-in wires, providing a light-transmitting glass envelope having a closed first end and an open second end, the first end being closed by an envelope press portion integral with the remainder of the envelope, the press portion having the lead-in wires sealed therein and extending therethrough into the envelope, introducing a forming gas into the envelope, flushing the envelope with infusions of the forming gas, flashing the filament in the presence of the forming gas to recrystallize the filament, evacuating the forming gas from the envelope, introducing fill gas into the envelope, and closing the envelope second end.

15 Claims, 9 Drawing Sheets

METHOD FOR RECRYSTALLIZATION OF TUNGSTEN FILAMENTS FOR INCANDESCENT LAMPS

BACKGROUND OF THE INVENTION

1. Field of the Invention

The invention relates to the manufacture of electric lamps, and is directed more particularly to a method for recrystallizing incandescent lamp tungsten filaments so as to provide a filament 9 having improved sag characteristics and resistance to cold fractures.

2. Description of the Prior Art

A typical incandescent gas-filled lamp produced today is provided with a filament made from potassium-doped grade non-sag (NS) tungsten wire of either a single coil or coiled-coil design. To develop a sag-resistant metallurgical structure, the filament must be recrystallized prior to its regular operation in a lamp. In a typical process, the tungsten coil is first mounted. The mount assembly is then hermetically press-sealed inside a glass tube at one end (the press seal end) and left open at the other end (the exhaust tube end). This glass-mount assembly is commonly referred to as pressware. The pressware is attached to exhaust-flush-fill equipment wherein a number of operations are performed to clean the coil, introduce a getter, and add the fill gas. In the last operation of exhaust, the pressware is frozen, thereby condensing the fill gas and creating a vacuum. The exhaust tube is heated and the glass collapses from external pressure, sealing the lamp (referred to as "tipping off"). At some point after tip off, the tungsten coil is recrystallized in the lamp atmosphere. In high volume lamp manufacturing, it is common practice to recrystallize ("flash") the filaments in fully assembled and sealed lamps before shipping. Although recrystallized NS tungsten coils are inherently brittle and break easily by shock or impact, they usually survive inplant drop tests and shipping to a customer's location. However, occasionally, a high rate of coil breakages during the drop tests or shipping is encountered.

Another common defect of recrystallized NS tungsten coils is excessive sag or creep during lamp operation, which is caused by sliding of tungsten grains relative to one another, thus distorting the filament geometry and often resulting in a collapse of adjacent coil turns and premature failures. A prominent feature found in lamp coils that have failed, either in drop tests, shipping, or due to sag, is a predominance of intergranular fractures, indicating that poor grain boundary strength is the common cause of failures. In contrast, fully recrystallized lamp coils that perform well in drop tests, shipping, and sag, when fractured by stretching or impact, usually exhibit long coiled segments and predominantly transgranular fracture surfaces.

Tungsten has very low solubility for interstitials, such as oxygen and carbon. Once the solubility limits are exceeded, tungsten oxides and carbides precipitate out of the tungsten matrix and deposit on grain boundaries, resulting in intergranular brittleness at ambient temperatures and loss of creep resistance at high temperatures. Trace amounts of residual air and moisture in incandescent lamps, including tungsten halogen, adversely affect properties and performance of coiled tungsten filaments. Interactions between these residuals and a filament cause brittleness, loss of sag resistance, bulb blackening and premature lamp failures. Particularly damaging to tungsten filaments is an interaction with oxygen and/or water during "flashing". During flashing, a nonsag, large, interlocking grain structure is formed in a coiled filament. This process is characterized by a rapid and massive movement and growth of the primary tungsten grains. At this stage, the available oxygen reacts with tungsten grain boundaries and other surfaces, producing weak, noncoherent grain boundary phases and, hence, intergranular brittleness and partial or total loss of sag resistance. Conventionally, coil flashing in mass-produced incandescent and tungsten halogen lamps consists of resistance heating of coiled filaments to, or above, the recrystallization temperature in fully assembled and sealed bulbs containing a fill gas. Usually, a fill gas comprises a mixture of an inert gas such as argon, krypton or xenon, nitrogen, and a halogen compound (in tungsten halogen lamps). Solid/gaseous oxygen and water getters are also present. Depending on the lamp type, the pressure inside the bulb ranges between below 1 atmosphere to a few atmospheres. Such fill gas compositions, while not damaging to tungsten, are not effective in removal of impurities from filaments, bulb walls or other parts of the lamp. Although the getters perform this function, the gettered impurities remain in the vessel for the life of the lamp. Because of the sporadic amounts of air/moisture residuals in mass-produced lamps, even in the presence of getters, fully flashed tungsten filaments are often excessively brittle, as evidenced by the high rates of coil fractures during lamp drop tests or shipping, and exhibit high sag rates during life.

SUMMARY OF THE INVENTION

An object of the invention is, therefore, to provide a method for recrystallization of a tungsten filament wherein the filament is flashed in a controlled environment before sealing of the lamp vessel.

A further object of the invention is to provide such a method wherein the flashing environment is such as to remove air and moisture from the lamp vessel, and remove filament surface impurities and reaction products from the lamp vessel before the vessel is sealed.

A still further object of the invention is to provide such a method which is easily integrated into present mass production lamp making equipment.

A still further object of the invention is to provide incandescent lamps with reduced filament breakage during production, drop testing, and shipment, and reduced filament sag during the operative lives of the lamps.

With the above and other objects in view, as will hereinafter appear, a feature of the present invention is the provision of a method for recrystallization of tungsten filaments for incandescent lamps, the method including the steps of providing a tungsten filament fixed to lead-in wires, providing a light-transmitting glass envelope having a closed first end and an open second end, the first end being closed by an envelope press portion integral with the remainder of the envelope, the press portion having the lead-in wires sealed therein and extending therethrough into the envelope, introducing a forming gas into the envelope, flushing the envelope with the forming gas, flashing the filament in the presence of forming gas to recrystallize the filament, evacuating the forming gas from the envelope, introducing fill gas into the envelope, and closing the envelope second end.

The above and other features of the invention, including various novel details of construction and combinations of steps, will now be more particularly described with reference to the accompanying drawings and pointed out in the claims. It will be understood that the particular method embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
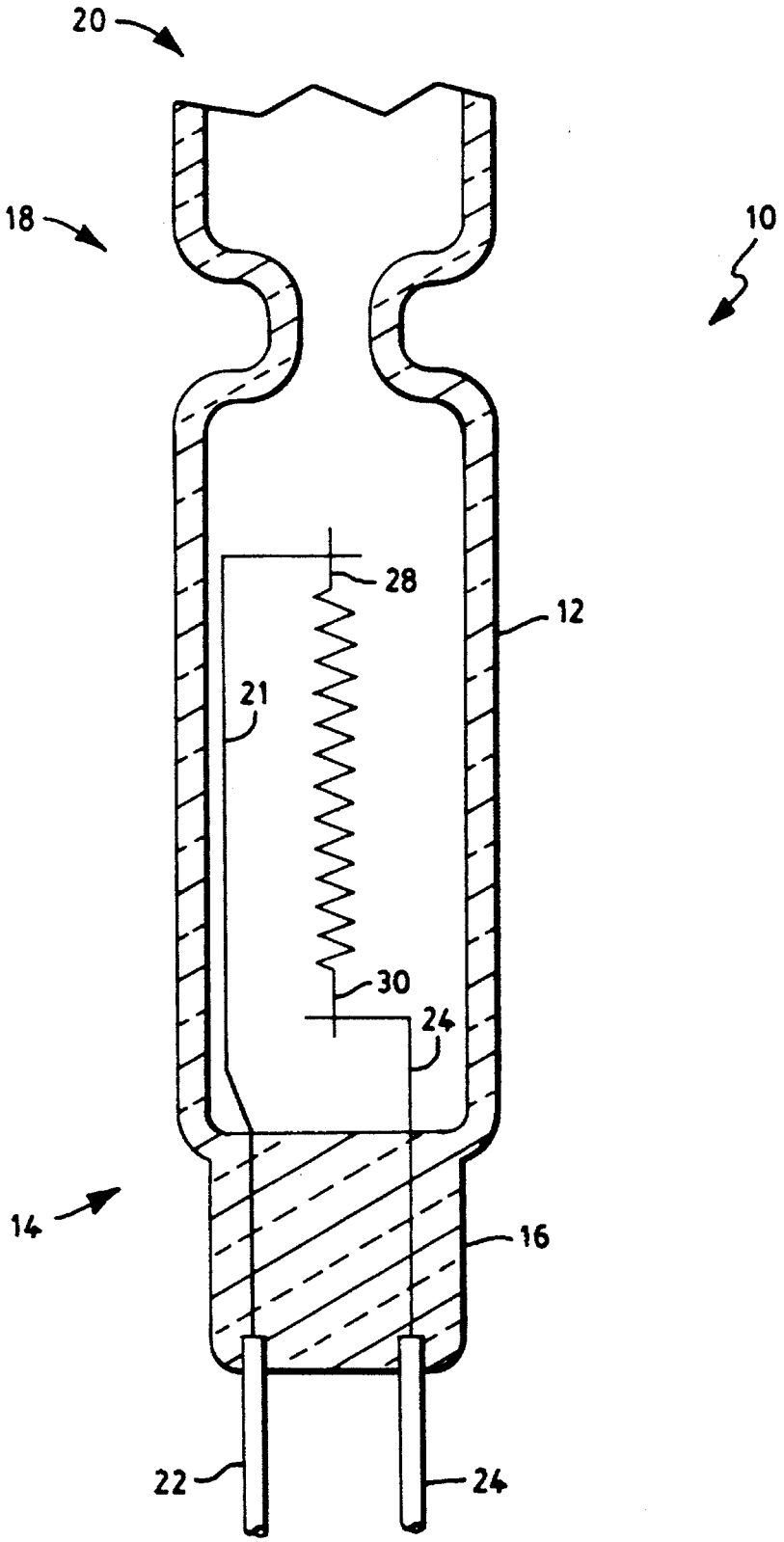
FIG. 1 is a diagrammatic sectional view of an incandescent lamp, illustrative of steps in an embodiment of the invention.

Referring to FIG. 1, it will be seen that an incandescent lamp 10 of the type to which the inventive method herein applies, includes an envelope 12 preferably of a light-transmitting glass. A first end 14 of the envelope 12 is closed by a press portion 16, which is usually of the same material as the envelope 12 and usually is formed integrally with the envelope 12. A second end 18 of the envelope 12 is closed in the finished product, but is open during most of the manufacturing process and, in particular, open during the recrystallization process disclosed herein. The open second end 18 of the envelope 12 is in communication with an exhaust tube portion 20 which is integral with the envelope 12. The exhaust tube portion 20, envelope 12, and press portion 16 are, as a unit, commonly referred to as "press-ware".

Still referring to FIG. 1, it will be seen that first and second lead-in wires 22, 24 are sealed in the press portion 16 and extend therethrough and into the envelope 12. A tungsten filament 26 is provided having a first end 28 fixed to the first lead-in wire 22 and a second end 30 fixed to the second lead-in wire 24.

Figure 2:
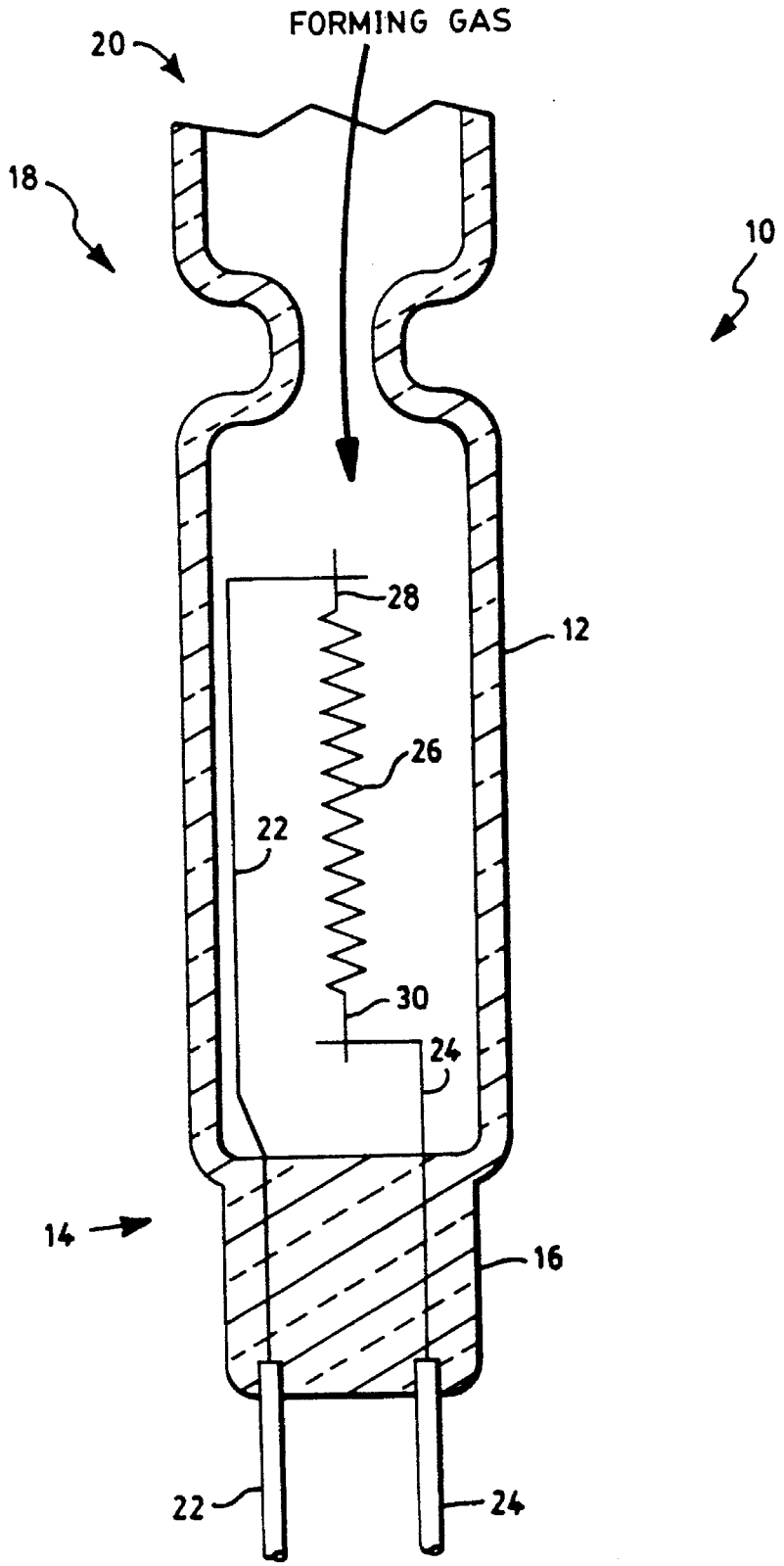
FIGS. 2–8 are similar to FIG. 1, but illustrate sequential steps in the inventive method.

The recrystallization process, in accordance with the invention, begins with the lamp 10 in the condition shown in FIG. 1, and as described above. In the recrystallization process, a forming gas is introduced into the envelope 12 through the exhaust tube 20 and the open second end 18 (FIG. 2).

The forming gas may be a mixture of carbon monoxide and nitrogen, such as 10% carbon monoxide and 90% nitrogen, or may be a hydrogen-rich mixture, such as pure dry hydrogen or a hydrogen-nitrogen mixture. The forming gas prevents oxidation of the tungsten filament during subsequent heating of the filament.

Figure 3:
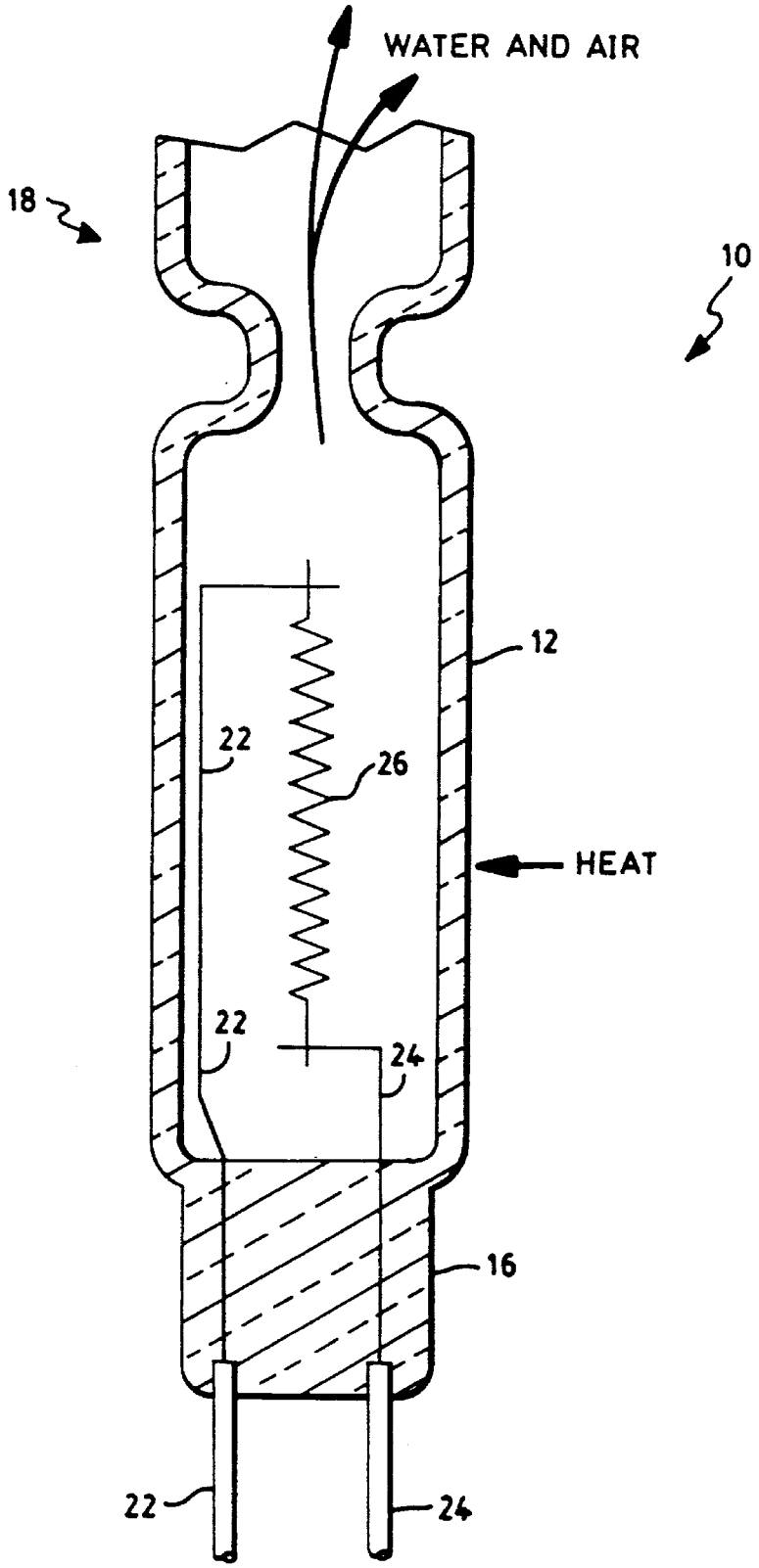
Figure 4:
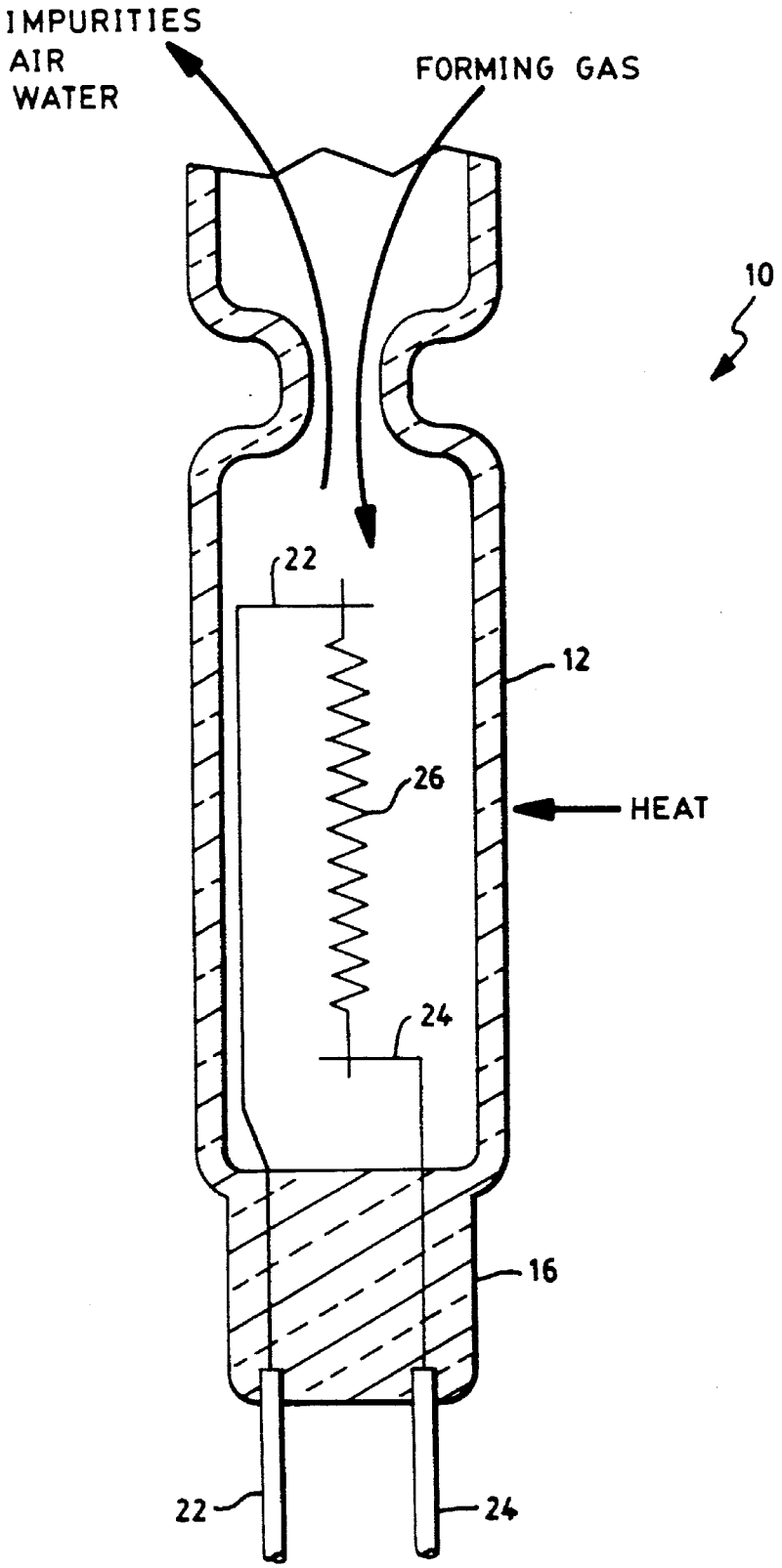

The envelope 12 preferably, but not necessarily, is then heated externally (FIG. 3) to a temperature of at least 400° C. and, preferably, to a temperature above 500° C., to evaporate water from the inside of the envelope. If heat is used to evaporate water, the heat on the envelope 12 may be maintained while the envelope is repeatedly flushed with infusions of the forming gas. Impurities in the envelope interior are dispelled in the flushing stage, along with water and air (FIG. 4). In many applications, the heating step may be omitted and the flushing with forming gas depended upon to remove most of the water and air present.

Figure 5:
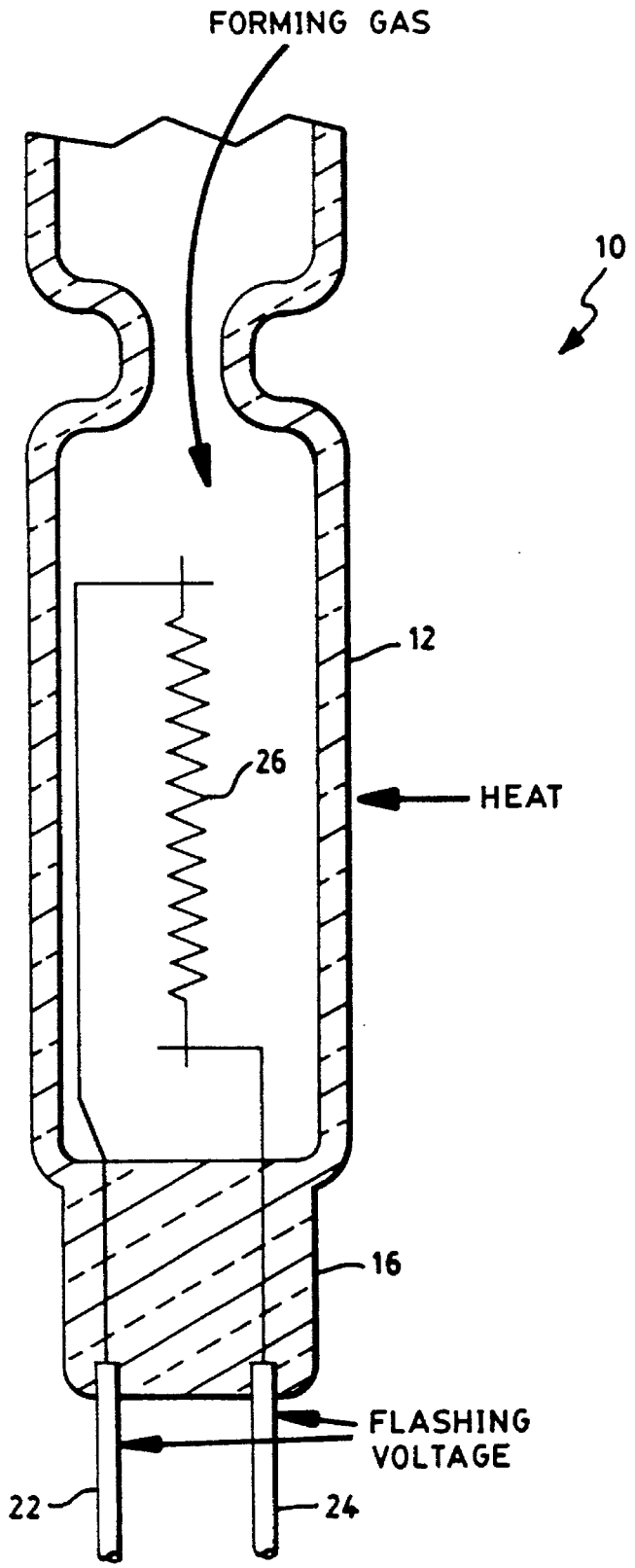

When the environment within the envelope 12 is substantially oxygen-free and impurity-free, the filament is flashed (FIG. 5) by applying a voltage across the exposed ends of the lead-in wires 22, 24. Applying a series of pulses, from 70 to 140 volts, has been found to fully recrystallize the tungsten filament. The forming gas flushing operation continues during flashing of the filament.

Figure 6:
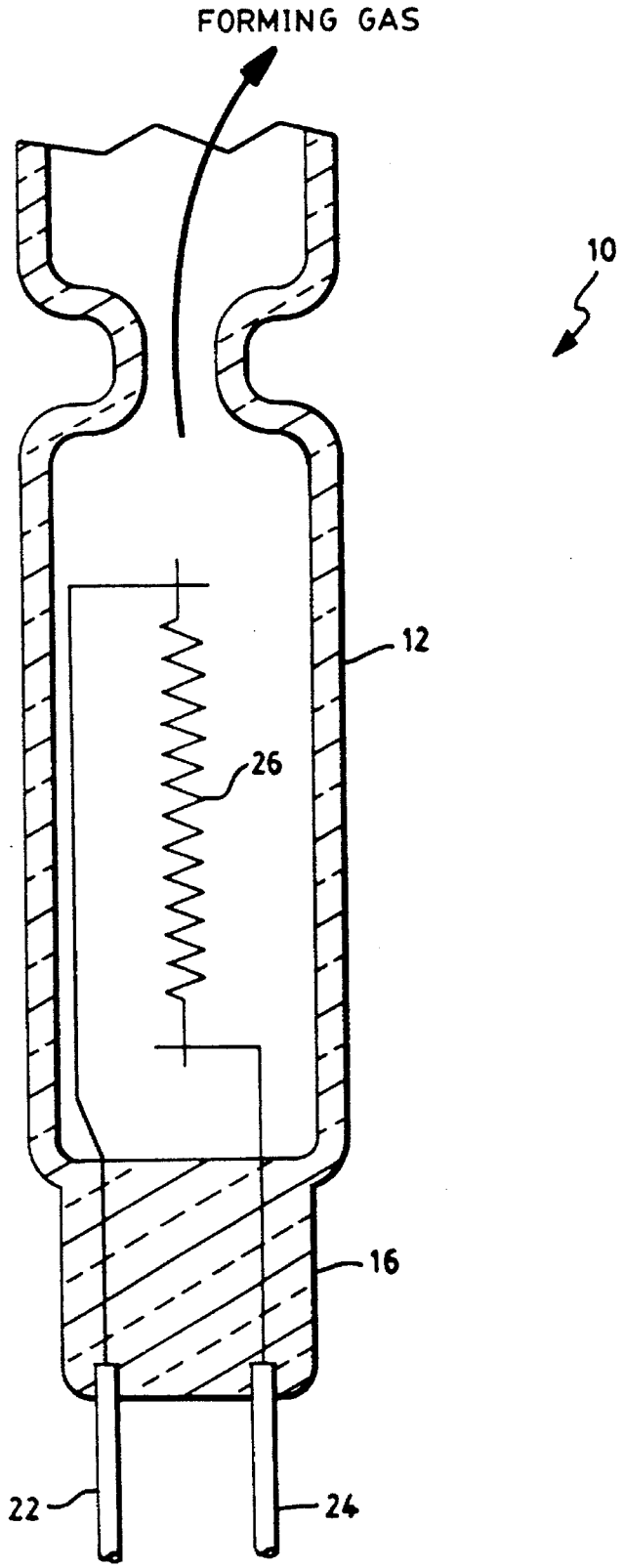
Figure 7:
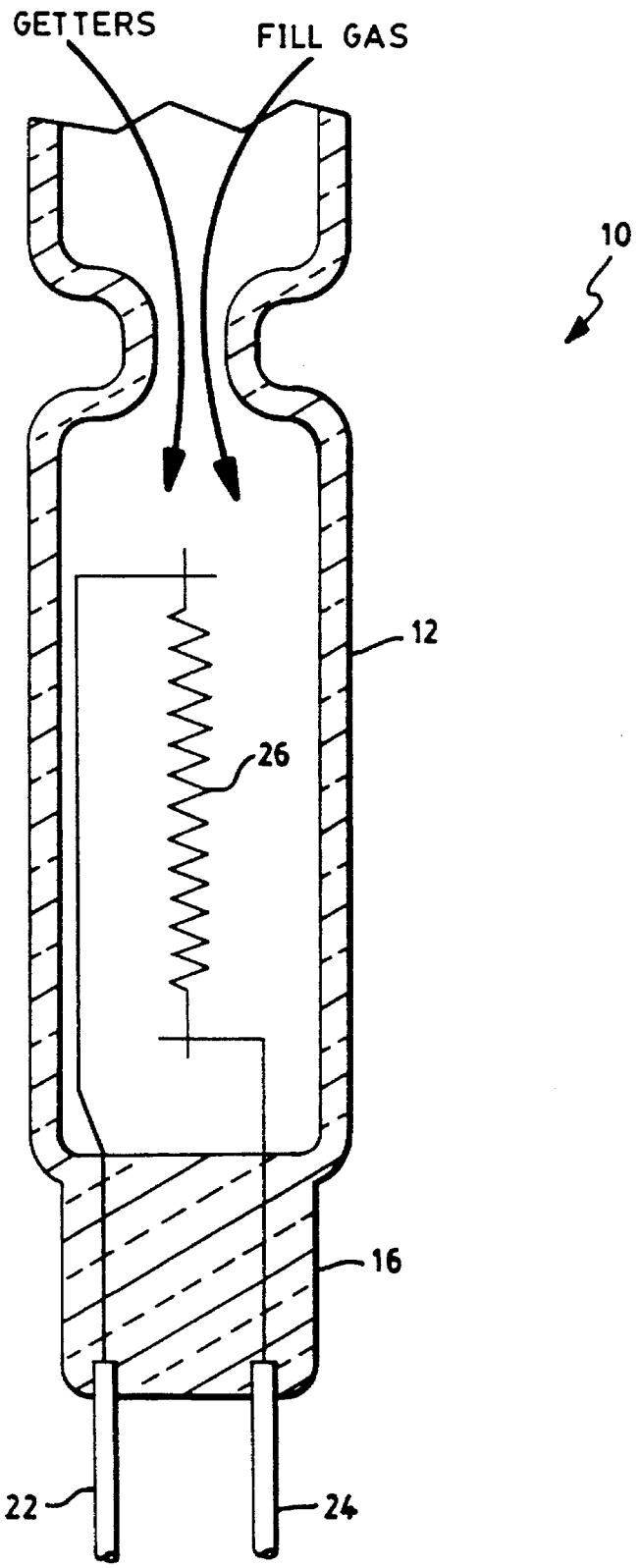
Figure 8:
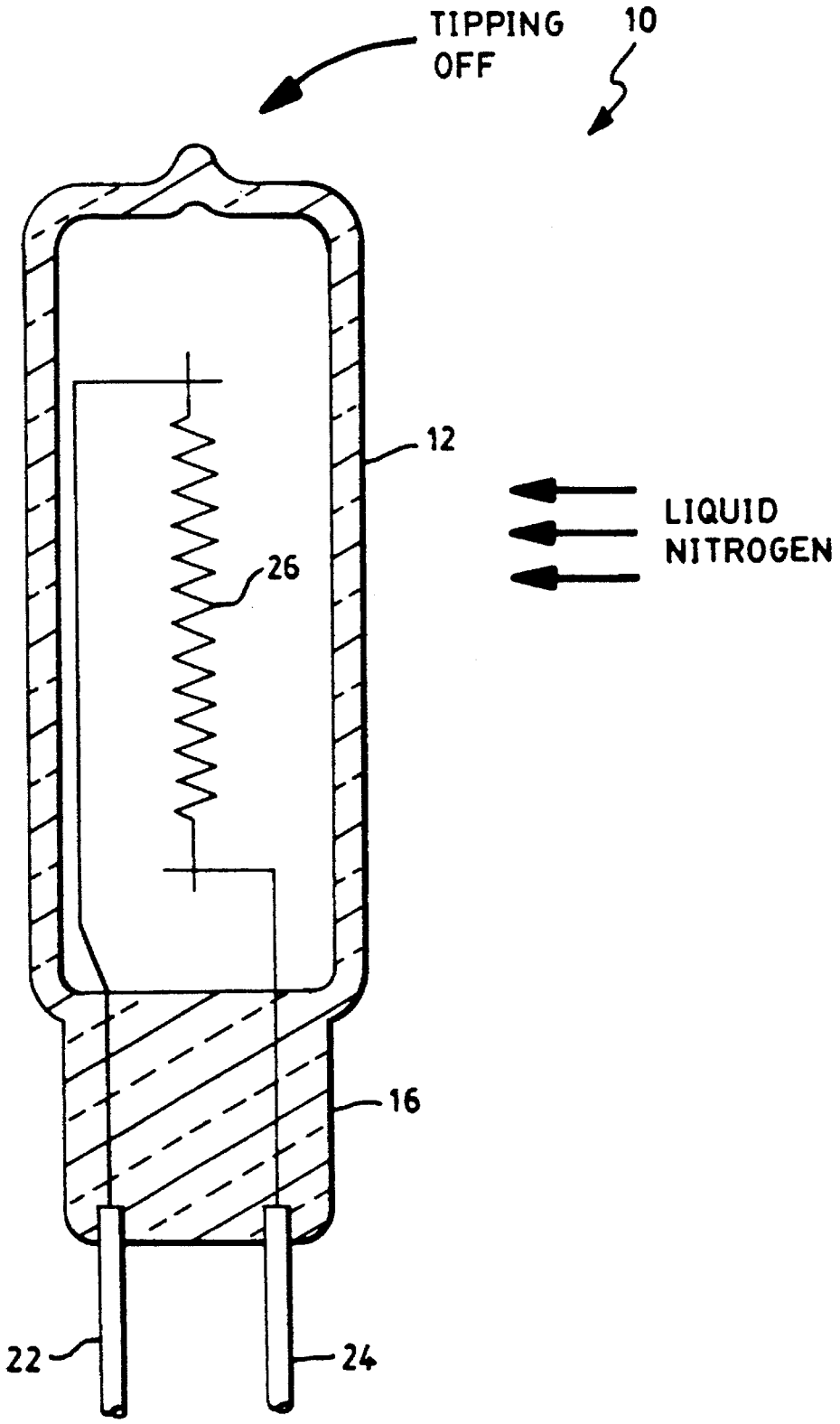
Figure 9:
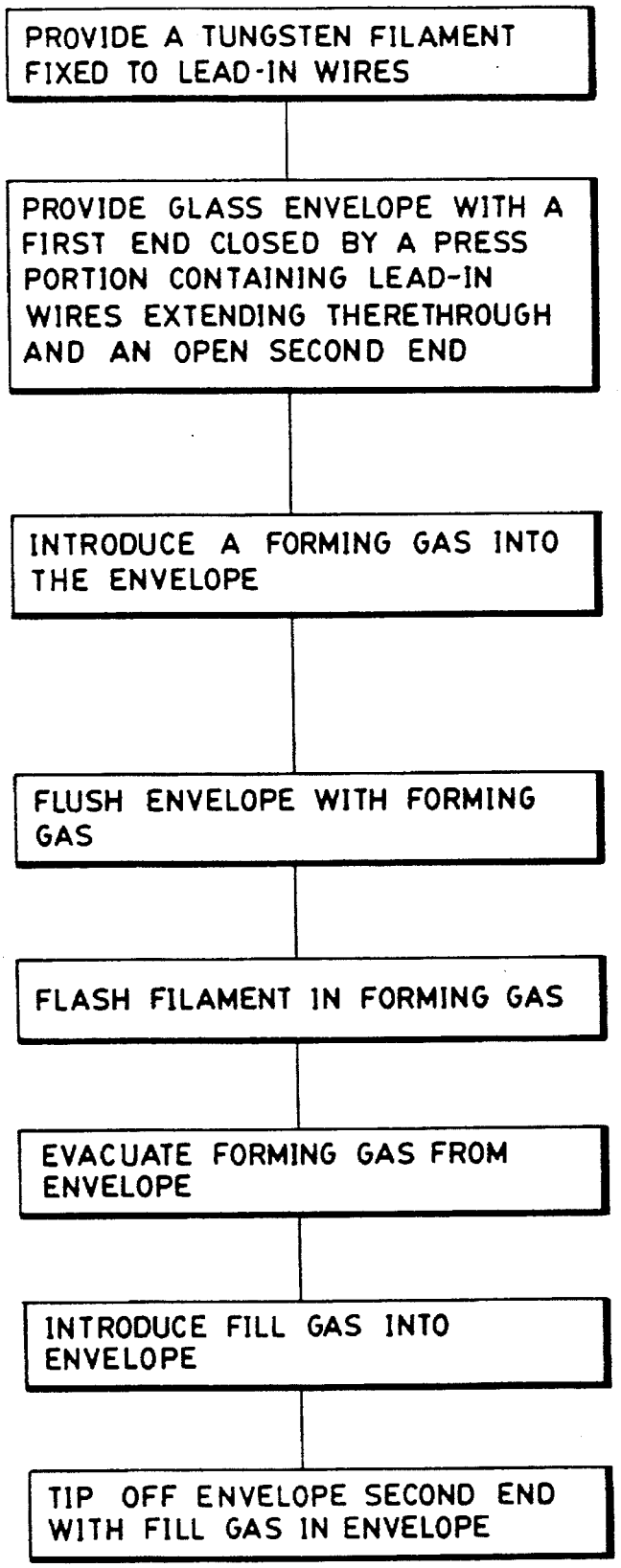
FIG. 9 is a chart illustrative of the inventive method herein.

Upon completion of the flashing operation, the forming gas is evacuated from the envelope 12 (FIG. 6) and gaseous getters and a fill gas are introduced into the envelope. In a halogen gas lamp, the halogen gas is introduced at this juncture. The envelope is then sprayed on its side with a jet of liquid nitrogen or immersed in liquid nitrogen, which causes the fill gas to condense and produces a vacuum within the envelope. The exhaust tube 20 proximate the open end 18 of the envelope 12 is heated, and a portion thereof collapses from external pressure, thereby "tipping off" the lamp.

There is thus produced an incandescent lamp having a tungsten filament of high grain boundary strength and high ductility, critical metallurgical characteristics of recrystallized filaments, to provide high resistance to sag and reduced brittleness. The lamp so manufactured provides the benefits of reduced breakage during production and shipment, and reduced sag during the operational life of the lamp.

It is to be understood that the present invention is by no means limited to the particular construction herein disclosed and/or shown in the drawings, but also comprises any modifications or equivalents within the scope of the claims.

Having thus described our invention, what we claim as new and desire to secure by Letters Patent of the United States is:

1. A method for recrystallization of tungsten filaments for incandescent lamps, said method including the steps of:

providing a tungsten filament fixed to lead-in wires;

providing a light-transmitting glass envelope having a closed first end and an open second end, said first end being closed by an envelope press portion integral with the remainder of said envelope, said press portion having said lead-in wires sealed therein and extending therethrough into said envelope;

introducing a forming gas into said envelope;

flushing said envelope with said forming gas to dispel air, moisture and impurities;

flashing said filament in the presence of said foaming gas by applying a voltage sufficient to fully recrystallize said filament;

evacuating said forming gas from said envelope;

introducing fill gas into said envelope; and closing said envelope second end.

2. The method in accordance with claim 1 wherein said flushing of said envelope with said forming gas is undertaken a plurality of times.

3. The method in accordance with claim 1, including the additional steps after introducing said fill gas into said envelope, of condensing said fill gas to create a vacuum in said envelope and heating said second end of said envelope to draw said glass envelope second end into an end-closing disposition, whereby to effect said closing of said envelope second end.

4. The method in accordance with claim 1 wherein said forming gas comprises a mixture of carbon monoxide and nitrogen.

5. The method in accordance with claim 1 where in said forming gas comprises a hydrogen-rich mixture.

6. The method in accordance with claim 1 wherein said forming gas comprises a mixture of hydrogen and nitrogen.

7. The method in accordance with claim 1 wherein said fill gas comprises carbon monoxide.

8. The method in accordance with claim 1 wherein along with said fill gas, halogen is introduced into said envelope.

9. The method in accordance with claim 1 wherein along with said fill gas, an oxygen and water getter is introduced into said envelope.

10. The method in accordance with claim 8 wherein along with said fill gas and said oxygen and water getter, halogen is introduced into said envelope.

11. The method in accordance with claim 1 wherein said flushing of said envelope with said forming gas is undertaken repeatedly.

12. The method in accordance with claim 10 wherein said forming gas comprises about 10% carbon monoxide and about 90% nitrogen.

13. The method in accordance with claim 1, including the additional step after introducing forming gas into said envelope, of applying heat to said envelope to evaporate water in said envelope.

14. The method in accordance with claim 13 wherein said envelope is heated to at least 400° C.

15. The method in accordance with claim 13, wherein said envelope is heated to at least about 500° C.

* * * * *